US006406338B1

(12) United States Patent
Endo et al.

(10) Patent No.: US 6,406,338 B1
(45) Date of Patent: Jun. 18, 2002

(54) BOARD TERMINAL AND METHOD OF PRODUCING SAME

(75) Inventors: Takayoshi Endo; Toshiharu Takahashi, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/576,433

(22) Filed: May 22, 2000

Related U.S. Application Data

(62) Division of application No. 09/349,939, filed on Jul. 8, 1999.

(51) Int. Cl.[7] ..... H01R 13/02

(52) U.S. Cl. ..... 439/885; 29/874; 29/882

(58) Field of Search ..... 439/885, 83, 632, 439/709, 712, 725, 876, 879, 877, 625–626; 206/330, 329, 524.7, 346, 347; 29/881, 882, 859, 739, 837, 845, 874, 877, 867, 838, 862, 863

(56) References Cited

U.S. PATENT DOCUMENTS

| | | | | | |
|---|---|---|---|---|---|
| 3,545,080 | A | * | 12/1970 | Evans | 29/887 |
| 3,905,665 | A | | 9/1975 | Lynch et al. | |
| 4,054,814 | A | * | 10/1977 | Fegley et al. | 439/885 |
| 4,127,935 | A | | 12/1978 | Ammon | 29/629 |
| 4,354,310 | A | * | 10/1982 | Hatton | 29/605 |
| 4,421,368 | A | * | 12/1983 | Saban | 439/885 |
| 4,530,560 | A | * | 7/1985 | Weilder | 439/885 |
| 4,545,634 | A | * | 10/1985 | Saijo | 439/885 |
| 4,595,248 | A | * | 6/1986 | Brown | 439/885 |
| 4,723,925 | A | * | 2/1988 | Orr, Jr. et al. | 439/877 |
| 4,733,465 | A | * | 3/1988 | Tanaka | 29/874 |
| 4,908,942 | A | * | 3/1990 | Long et al. | 29/882 |
| 5,176,254 | A | * | 1/1993 | Caravona | 206/330 |
| 5,190,486 | A | | 3/1993 | Tsuk | 439/886 |
| 6,052,895 | A | * | 4/2000 | Bianca et al. | 29/881 |

FOREIGN PATENT DOCUMENTS

| | | | | |
|---|---|---|---|---|
| EP | 3102788 | * | 4/1991 | 439/885 |
| JP | 03-155425 | * | 10/1989 | H01R/43/16 |

* cited by examiner

*Primary Examiner*—Neil Abrams
*Assistant Examiner*—J. Duverne
(74) *Attorney, Agent, or Firm*—Morgan, Lewis & Bockius LLP

(57) ABSTRACT

Board terminals 12, each including a tapering insertion portion 13 for insertion into a through hole in a board, a soldering portion 14 to be soldered to the board, and a connection portion 15 for connection to a mating terminal, are produced from a wire 11, the insertion portion, the soldering portion and the connection portion being continuously arranged in this order in a direction of a length of the board terminal. The wire 11 has a width larger than a thickness thereof. The insertion portion 13 is formed by pressing the wire, and the soldering portion 14 is formed by cutting or pressing widthwise opposite side portions of that portion of the wire extending from the insertion portion 13, the soldering portion having a width smaller than the width of the wire. Those portions, removed from the wire by cutting or pressing, are very small, and generally the whole of the wire can be formed into the board terminal, and therefore a loss of the material is reduced.

4 Claims, 3 Drawing Sheets

BOARD TERMINAL AND METHOD OF PRODUCING SAME

This application is a division of Ser. No. 09/349,939, filed Jul. 8, 1999.

BACKGROUND OF INVENTION

1. Field of Invention

This invention relates to a tab-like board terminal which is designed to be inserted into a through hole in a printed circuit board to be connected thereto, and the invention also relates to a method of producing this board terminal.

2. Related Art

FIGS. 5 and 6 show a conventional method of producing board terminals. The board terminals are produced using a wide sheet 1 (shown in FIG. 5(*a*)) having a predetermined small thickness, for example, of 0.64 mm. Electrically-conductive metal is plated on the surfaces of the sheet 1, and then this sheet is blanked or stamped by a pressing die, thereby forming a pressed product 2 shown in FIG. 5(*b*).

The pressed product 2 includes two pre-shaped portions 3 (to serve as board terminals) interconnected by a first carrier portion 4 and a second carrier portion 5. The first carrier portion 4 serves as a portion through which the sheet is fed when the blanking operation is to be effected by the pressing die. The second carrier portion 5 serves to prevent the board terminals from being deformed when taking up the board terminals. These carrier portions are cut off and discarded simultaneously when cutting off the pre-shaped portions 3 from the pressed product 2.

Each of the pre-shaped portions 3 includes a tapering insertion portion 6 connected to the first carrier portion 4, a soldering portion 7 extending from the insertion portion 6, and a connection portion 8 extending from the soldering portion 7. The insertion portion 6 is adapted to be inserted into a through hole in a printed circuit board, and the soldering portion 7 is adapted to be soldered to the printed circuit board, and the connection portion 8 is adapted to be connected to a mating terminal. The blanking is effected in such a manner that the width h1 (see FIG. 6) of the soldering portion 7 is 0.60 mm, and the width h2 of the connection portion 8 is 1.00 mm.

In the above conventional method, however, a waste portion 9 as indicated by hatching in FIG. 6 is produced, and besides the first carrier portion 4 and the second carrier portion 5 must be discarded. Therefore, the loss of the material is large, and the yield rate of the products relative to the used material is low.

And besides, the plating is not formed on those portions press-cut by the pressing die, and therefore there is encountered another problem that the reliability of soldering is low. Furthermore, the pressed product 2 (shown in FIG. 5(*b*)) of a complicated shape is formed from the sheet 1 (shown in FIG. 5(*a*)), and therefore the pressing die is complicated, and is expensive.

SUMMARY OF INVENTION

It is therefore an object of this invention to provide a board terminal which can be formed with a reduced loss of a material, and can enhance a soldering reliability, and does not need a complicated pressing die in the production, and an another object is to provide a method of producing this board terminal.

The above object has been achieved by a board terminal of the present invention including a tapering insertion portion for insertion into a through hole in a board, a soldering portion to be soldered to the board, and a connection portion for connection to a mating terminal, the insertion portion, the soldering portion and the connection portion being continuously arranged in this order in a direction of a length of the board terminal, provided in that the insertion portion is formed by pressing a wire having a width larger than a thickness thereof, and the soldering portion is formed by cutting or pressing widthwise opposite side portions of the wire, and has a width smaller than the width of the wire.

In the board terminal of this invention, the insertion portion is formed by pressing the wire having the width larger than the thickness thereof, and the soldering portion is formed by cutting the widthwise opposite side portions of the wire, and has the width smaller than the width of the wire. Those portions, which are cut off from the wire, and are discarded, are produced only when the soldering portion is formed by the above cutting operation. Therefore, generally the whole of the wire can be formed into the board terminal, and the production can be performed with a minimum loss of the material.

The soldering portion, formed by cutting or pressing the wire, has the width which is smaller than the width of the wire, and is generally equal to the thickness of the wire, so that this soldering portion has a generally square cross-section. Therefore, a thermal stress, developing when soldering the board terminal to the printed circuit board, is uniform, and a crack will not develop during the soldering operation. And besides, since the soldering portion has a reduced width, the diameter of the through hole can be reduced, and the board terminals can be mounted at a high density on the printed circuit board.

In the first aspect of the present invention, recesses are formed in the connection portion.

The connection portion is connected to the mating terminal, and therefore part of the connection portion is embedded in the connector. In this invention, the recesses are formed in the connection portion, and a resin of the connector intrudes into the recesses, so that the resin and the recesses engage each other. Therefore, the board terminal can be stably mounted on the connector.

In the first or second aspect of the present invention, electrically-conductive metal is plated on an outer surface of the board terminal.

In this invention, since the electrically-conductive metal is plated on the outer surface, the reliability of the soldering is enhanced.

According to the present invention, there is provided a method of producing a board terminal including a tapering insertion portion for insertion into a through hole in a board a soldering portion to be soldered to the board, and a connection portion for connection to a mating terminal, the insertion portion, the soldering portion and the connection portion being continuously arranged in this order in a direction of a length of the board terminal; provided by the steps of forming the insertion portion by pressing a wire having a width larger than a thickness thereof; and forming the soldering portion by cutting or pressing widthwise opposite side portions of that portion of the wire extending fro the insertion portion, the soldering portion, the soldering portion having a width smaller than the width of the wire.

In this invention, there is used the wire having the width larger than its thickness, and the insertion portion is formed by pressing the wire, and the soldering portion is formed by cutting or pressing the widthwise opposite side portions of the wire. Therefore, there is no need to use a complicated pressing die, and the board terminal can be easily produced.

Those portions, which are cut off from the wire, and are discarded, are only those portions cut for forming the soldering portion, and therefore generally the whole of the wire can be formed into the board terminal, and therefore the production can be performed with a minimum loss of the material.

In the present invention, recesses are formed in a connection portion-forming portion of the wire simultaneously when forming the insertion portion by pressing.

In this invention, the recesses in the connection portion are formed simultaneously when forming the insertion portion by pressing, and therefore the number of the process steps is not increased, and the board terminal can be easily produced.

In the present invention, electrically-conductive metal is plated on the board terminal after the pressing or the cutting of the widthwise opposite side portions.

Only the board terminal is formed using the wire as the material, and therefore the construction is simple. Therefore, the plating can be applied to the board terminal over the entire surface thereof, and this plating enhances the reliability of the soldering.

DETAILED DESCRIPTION OF PREFERRED EMBODIMENTS

Figure 1:
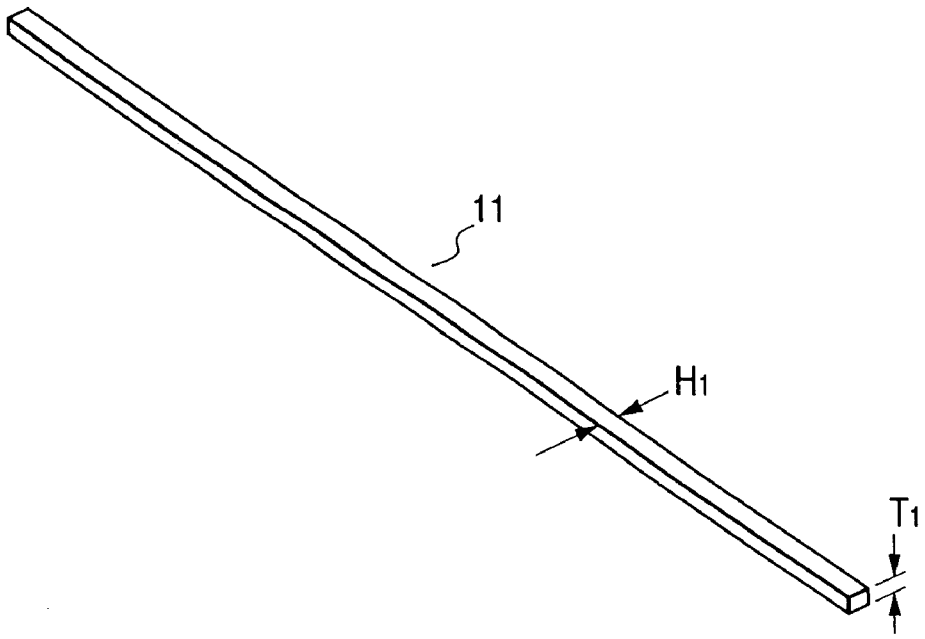
FIG. 1 is a perspective view of a wire used for producing one preferred embodiment of a board terminal of the present invention.
Figure 2:
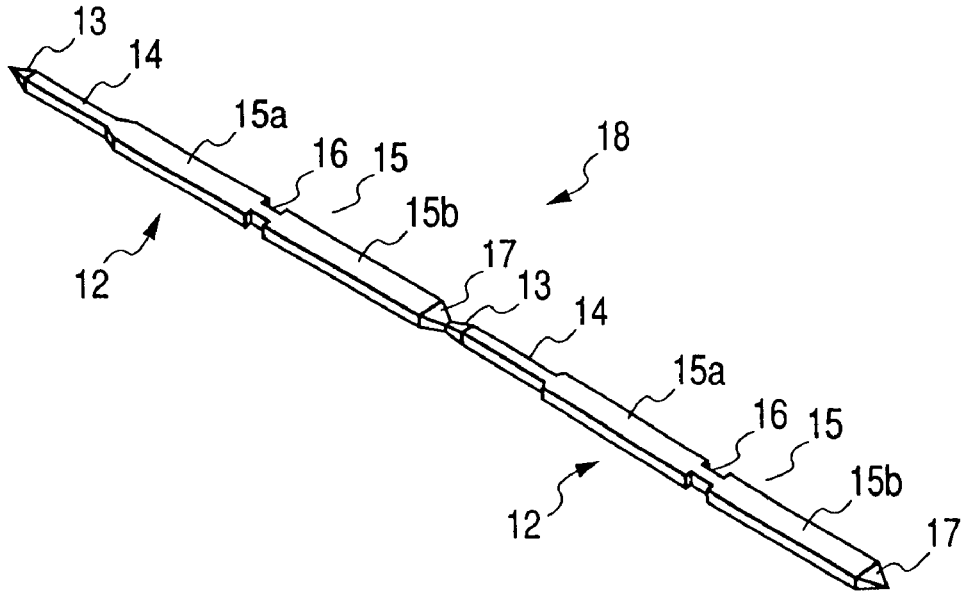
FIG. 2 is a perspective view of a pre-shaped product, having two board terminals serially connected together, which pre-shaped product is formed by processing the wire.

FIGS. 1 and 2 show sequentially the steps of producing one preferred embodiment of board terminals of the present invention. In this embodiment, a wire 11 of a rectangular cross-section is formed, and the board terminals 12 are produced, using this wire 11 as a material.

As shown in FIG. 2, the board terminal 12 includes a tapering insertion portion 13, a soldering portion 14 extending from the insertion portion 13, and a connection portion 15 extending from the soldering portion 14. The insertion portion 13 is adapted to be inserted into a through hole 20 (see FIG. 4) in a printed circuit board 19, and the soldering portion 14, passing through the through hole 20, is adapted to be connected by soldering to a pattern (not shown) on the printed circuit board 19.

The connection portion 15 is mounted on a connector (not shown) by embedding part of this connection portion 15 in the connector, and in this mounted condition, the connection portion 15 is contacted with and connected to a mating terminal (not shown). In FIG. 2, the connection portion 15 has an embedding portion 15*a* to be embedded in the connector, and a contact section 15*b* to be contacted with the mating terminal. A connection guide end 17 of a tapering shape to be inserted into a mating connector (not shown) is formed at the distal end of the connection section 15*b*.

Figure 3:
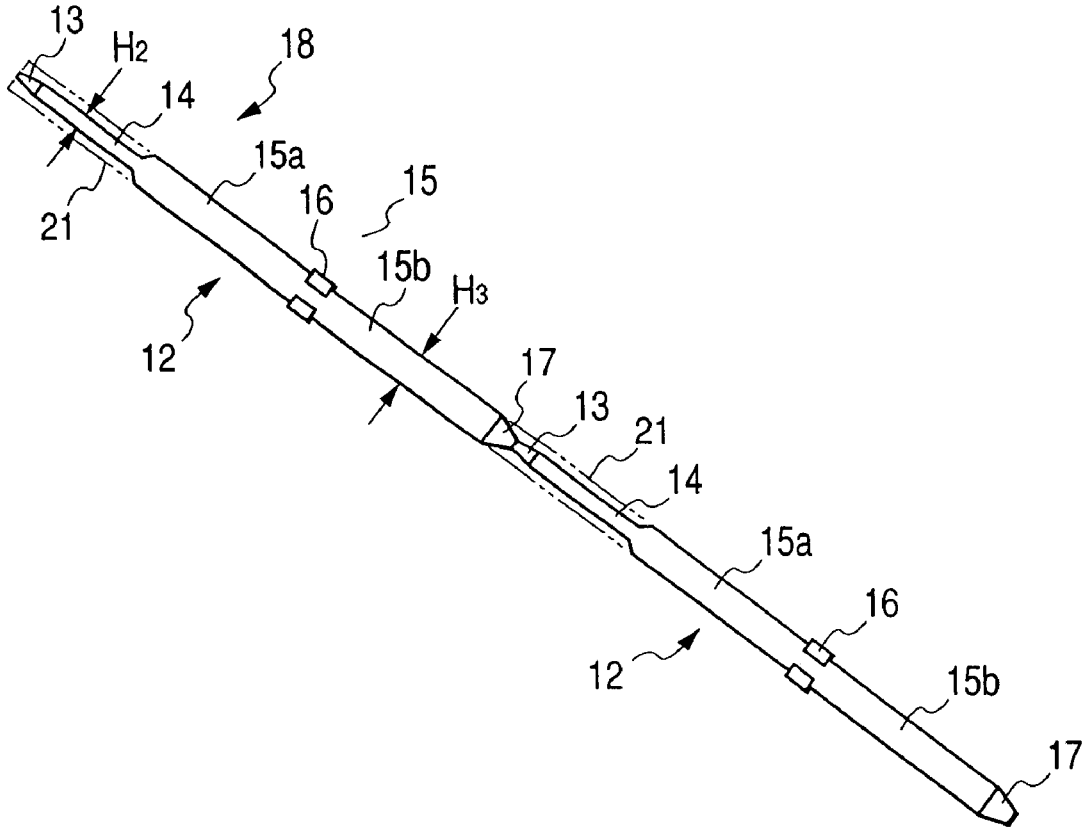
FIG. 3 is a perspective view of the pre-shaped product, showing cut-off portions in the embodiment.

In this board terminal 12, the largest stress acts on the connection portion 15 for contact with the mating terminal. Therefore, the connection portion 15 need to be larger in width than the insertion portion 13 and the soldering portion 14, and the width H3 (see FIG. 3) of the connection portion is 1.00 mm.

In the board terminal 12 of this embodiment, recesses 16 are formed in the embedding portion 15*a* of the connection portion 15. The recesses 16 are formed by pressing the relevant portions of the connection portion 15 in the direction of the thickness of the sheet (square wire), and a resin of the connector can intrude into the recesses 16. As a result of the intrusion of the resin, the recesses 16 and the resin engage each other, so that the board terminal 12 can be firmly mounted on the connector.

Next, the production of the board terminal 12 will be described. As shown in FIG. 1, the wire 11, serving as the material for the board terminal 12, is elongate. The width H1 of this wire 11 is larger than its thickness T1.

In order that the board terminal 12 can be produced from the wire 11 with a minimum loss of the material, it is necessary that the outside dimension of the wire 11 should be equal to the largest one of the outside dimensions of the board terminal 12. Therefore, the wire 11 is so formed that its outside dimension coincides with the dimension of the connection portion 115 of the board terminal 12. Therefore, in this embodiment, the wire 11 is so formed that the thickness T1 is 0.64 mm, and that the width H1 is 1.00 mm which is larger that the thickness T1, and is equal to the width of the connection portion 15.

In this embodiment, two board terminals 12 are produced from one wire 11, and the wire 11 has a length equal to the sum of the lengths of two boar terminals 12.

The wire 11 is pressed, thereby simultaneously forming the tapering insertion portions 3, the recesses 16 at the central portion of each connection portion 15, and the tapering connection insertion end 17 at the end of each connection portion 15. These portions are formed or shaped by one pressing operation, and by doing so, the number of pressing operations can be reached, and the number of the process steps can be reached.

After this pressing operation, the widthwise opposite side portions of each soldering portion-forming portion are subjected to cutting or pressing, thereby forming the soldering portions 14. The width H2 (H2=0.6 mm) of each soldering portion 14, thus formed by cutting the widthwise opposite side portions, is smaller than the width H1 (H1=1.00 mm) of the wire 11, and is close in value to the thickness T1 (T1–0.64 mm) of the wire 11 (the board terminal 12).

As a result of the above pressing and cutting operations, a pre-shaped product 18, having the two board terminals 12 serially connected together, is formed as shown in FIG. 2. Electrically-conductive metal is plated on the thus formed pre-shaped product 18. With this plating, a film of electrically-conductive metal can be firmly formed on the pre-shaped product 18 uniformly over the entire surface thereof. The reason for this is that the pre-shaped product 18, shown in FIG. 2, is simple in construction, and does not have any complicated hole and bent portion.

After this plating is effected, the pre-shaped product 18 is cut at its central portion, thereby separating the two board terminals 12 from each other. The thus separated board terminals 12 can be mounted on the printed circuit board 19.

For mounting the board terminal on the printed circuit board 19, the insertion portion 13 is inserted into the through hole 20 in the printed circuit board 19, and the soldering portion 14 is soldered to a pattern on the printed circuit board 19. The width H2 of the soldering portion 14 has been made generally equal to the thickness T1 by the above cutting operation, and therefore the soldering portion 14 has a generally square cross-section. Therefore, a thermal stress, developing during the soldering operation, is uniform, and the soldering can be effected satisfactorily without forming any crack.

In this production, those portions, which are cut off from the wire 11, and are discarded, are produced only when the soldering portions 14 are formed by the above cutting operation. Namely, the cut-off portions 21 are only those (indicated in broken lines in FIG. 3) disposed on the opposite sides of the soldering portions 14, and the amount of the cut-off portions 21 is small, and generally the whole of the wire 11 can be formed into the board terminals 12. Therefore, a loss of the material is small, and the yield rate can be enhanced.

Figure 4A:
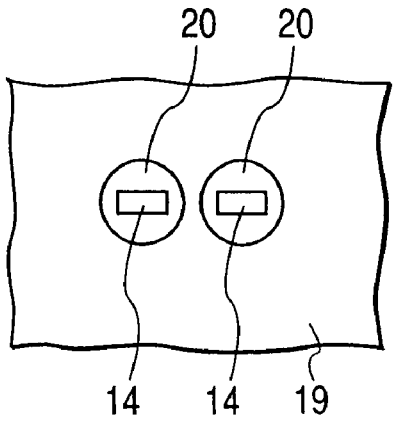
FIG. 4(*a*) is a plan view showing the relation between a soldering portion of the embodiment and a through hole, and FIG. 4(*b*) is a plan view showing the relation between the square portion, not subjected to cutting, and a through hole.
Figure 4B:
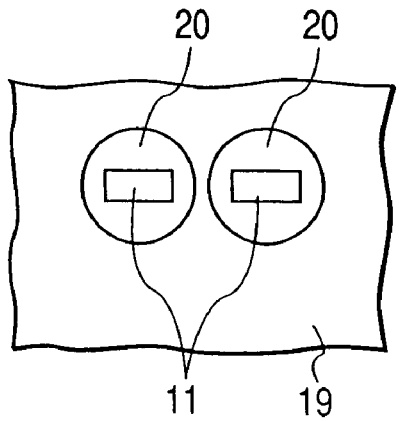
Figure 5A:
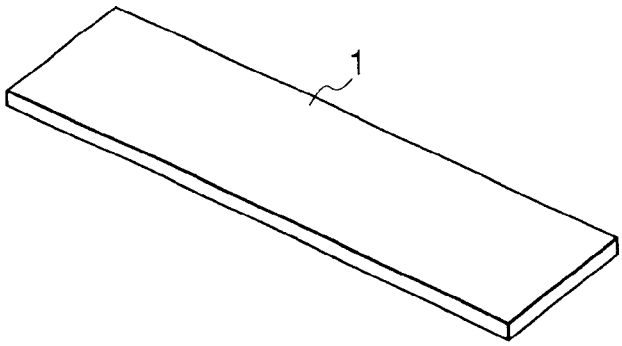
PRIOR ART FIG. 5(a)
FIG. 5 shows a conventional production method, and FIG. 5(*a*) is a perspective view showing a sheet, and FIG. 5(*b*) is a perspective view showing a pressed product formed by the conventional method.
Figure 5B:
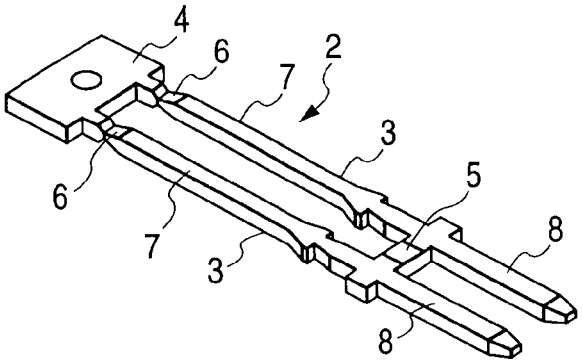
PRIOR ART FIG. 5(b)
Figure 6:
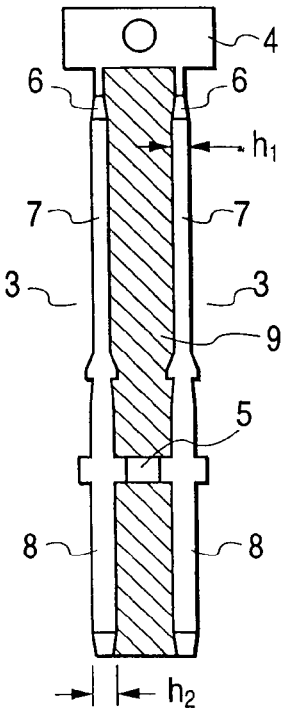
PRIOR ART FIG. 6
FIG. 6 is a plan view showing problems with the conventional method.

FIG. 4(*a*) shows the relation between the soldering portion 14, passing through the through hole 20 in the printed circuit board 19, and the through hole 20 when the insertion portion 13 of this embodiment is inserted into the through hole 20. As described above, the width of the soldering portion 14 is reduced by the cutting operation, and therefore the diameter of the through hole 20 can be reduced. Therefore, the board terminals 12 can be mounted at a high density on the printed circuit board 19 FIG. 4(*b*) shows the case where the cutting operation or the pressing operation is not effected, and in this case, the through hole 20 must have a diameter corresponding to the width H1 of the wire 11, and the board terminals can not be mounted at a high density.

As described above, generally the whole of the wire can be formed into the board terminals, and the board terminals can be produced with a minimum loss of the material. And besides, any crack will not develop when soldering the board terminal to the printed circuit board, and also the diameter of the through holes can be reduced, so that the board terminals can be mounted at a high density on the printed circuit board.

In the present invention, the resin of the connector intrudes into the recesses in the connection portion, so that the resin and the recesses engage each other. Therefore, the board terminal can be stably mounted on the connector.

In the present invention, since the electrically-conductive metal is plated on the board terminal, the reliability of the soldering is enhanced.

In the present invention, generally the whole of the wire can be formed into the board terminal, and therefore the production can be performed with a minimum loss of the material.

In the present invention, the recesses in the connection portion are formed simultaneously when forming the insertion portion by pressing, and therefore the number of the process steps is not increased, and the board terminal can be easily produced.

In the present invention, the plating can be applied to the board terminal over the entire surface thereof, and this plating enhances the reliability of the soldering.

What is claimed is:

1. A method of producing a board terminal including a tapering insertion portion for insertion into a through hole in a board, a soldering portion to be soldered to the board, and a connection portion for connection to a mating terminal, said insertion portion, said soldering portion and said connection portion being continuously arranged in this order in a direction of a length of said board terminal, comprising the steps of:

forming said tapering insertion portion by pressing a wire having a width larger than thickness thereof; and forming said soldering portion by one of cutting and pressing widthwise opposite side portions of that portion of said wire extending from said tapering insertion portion such that said soldering portion having a width smaller than the width of said square wire.

2. A method of producing a board terminal according to claim 1, in which recesses are formed in the connection portion-forming portion of said wire simultaneously when forming said tapering insertion portion by pressing.

3. A method of producing a board terminal according to claim 1, in which electrically-conductive metal is plated on said board terminal after the pressing or the cutting of said widthwise opposite side portions.

4. A method of producing a board terminal according to claim 2, in which electrically-conductive metal is plated on said board terminal after the pressing or the cutting of said widthwise opposite side portions.

* * * * *